United States Patent [19]

Clark, Jr.

[11] Patent Number: 4,934,542

[45] Date of Patent: Jun. 19, 1990

[54] BABY BOTTLE EQUIPPED WITH BOTTLE NIPPLE SHIELD

[76] Inventor: Donald P. Clark, Jr., 4100 Windmill Pl., Charlotte, N.C. 28226

[21] Appl. No.: 393,379

[22] Filed: Aug. 14, 1989

[51] Int. Cl.[5] ..... A61J 9/00; A61J 9/08; A61J 13/00

[52] U.S. Cl. ..... 215/11.1; 215/11.6; 215/365

[58] Field of Search ..... 215/2, 11.1, 11.6, 12.1, 215/100 R, 365; 220/90.2, 90.4, 90.6; 128/359, 360; 248/105

[56] References Cited

U.S. PATENT DOCUMENTS

| | | | |
|---|---|---|---|
| 976,887 | 11/1910 | Ladley | 215/11.1 |
| 1,106,927 | 8/1914 | Decker | 215/11.6 |
| 1,635,070 | 7/1927 | Clark | 215/2 |
| 2,033,296 | 3/1936 | Porter | 248/105 |
| 2,084,689 | 6/1937 | Karl | 215/11.6 |
| 2,366,214 | 1/1945 | Ramaker | 215/11.1 |
| 2,630,932 | 3/1953 | Lestakis | 215/11.1 |
| 2,706,571 | 4/1955 | Ryan | 215/12.1 |
| 2,809,760 | 10/1957 | Clark | 215/11.1 |
| 3,363,630 | 1/1968 | Hines | 128/360 |
| 3,718,360 | 2/1973 | Knutzen | 294/27 |
| 3,990,596 | 11/1976 | Hoftman | 215/11.1 |
| 4,050,600 | 9/1977 | Jennings | 215/11.1 |
| 4,629,080 | 12/1986 | Carveth | 215/11.1 |
| 4,726,847 | 2/1988 | Mitri | 220/90.2 |
| 4,759,139 | 7/1988 | Ricks | 215/11.1 X |

*Primary Examiner*—Sue A. Weaver

*Attorney, Agent, or Firm*—Bell, Seltzer, Park & Gibson

[57] ABSTRACT

A baby bottle equipped with a uniquely effective bottle nipple shield is provided which permits continuous access by the child to the contents of the bottle while simultaneously protecting the nipple from contamination if the bottle is dropped on a surface. In the preferred construction, the nipple shield of the bottle of the invention includes a generally planar base member which defines a central bore in substantially coaxial relation to the nipple proper and which mounts a pair of wing members which project generally upwardly from the base member in spaced apart relation to each other and in substantially parallel relation to the principal axis of the nipple. The projecting wing members terminate with their respective upper free ends position in fixed spaced apart relation to one another so that continuous access to the nipple is enabled. In a particular preferred construction, the projecting wing members are configured in a lobular shape which protects the nipple through rotational movements of the bottle such as are routinely experienced in lifting the bottle once it has been dropped to protect the nipple as well as interior furnishings.

9 Claims, 2 Drawing Sheets

BABY BOTTLE EQUIPPED WITH BOTTLE NIPPLE SHIELD

BACKGROUND OF THE INVENTION

This invention relates to a greatly improved construction for a baby bottle which incorporates a unique bottle nipple shield. The invention overcomes many practical problems which have plagued the use of bottles of this type, particularly by toddlers. The bottle of this invention incorporating the nipple shield provides reassurance to parents of young children who are concerned with possible contamination of the nipple when the bottle is within the child's exclusive possession and is dropped on a surface. Thus, this invention is provided which is particularly adapted for use by children who have relatively poor manual dexterity—i.e., all of them.

The general public is keenly aware of the increasing number of young children in households where the parent or parents are employed outside of the home or because of other circumstances the children are placed in outside day-care or other care facilities where direct care or continuous supervision is simply impossible. In a related vein, parents of young children also often resort to the use of baby-sitters who may be less than fully attentive to the sanitary conditions of the nipple of a child's baby bottle after it has been dropped. Moreover, in any household with pets, the problem of contamination of a nipple from pet hair is virtually impossible to eliminate no matter how much effort is expended. And, no matter how attentive the parent may be, the frequency of drops and spills, particularly by younger toddlers, virtually ensures that the nipple will contact some foreign object.

The continuing desire for a sanitary baby bottle including a sanitary nipple appears to be widely recognized since bottle sterilizers and bottle caps for particular protection of the nipple are widely available. Thus, child care sections of any department or grocery store provide countless options for preserving the sterility of the contents of the bottle, including advantages provided by disposable liners, for example, or sterilizers for glass bottles or the like. On the other hand, a substantial need is presented for a bottle equipped with an effective guard against contamination of the nipple when the bottle is itself in use. In a related manner, an effective bottle nipple shield must provide effective protection, while at the same time allowing the child virtually continuous access to the nipple itself for dispensing the contents. If continuous protection were available, a parent would have no need to be concerned with repeatedly applying caps to the bottle during use only to have to remove the same within as little as a few minutes. In a related vein, the parent need not be concerned with the need to repeatedly inspect the nipple or with having to rinse the surface thereof during use after it has been dropped.

A study of the prior art addressed to bottles for nursing young children or toddlers reveals an absence of any satisfactory structure addressing the above needs for continuous protection of the nipple while simultaneously providing access thereto. Instead, studies of the prior art reveal numerous contraptions primarily designed for protecting the body of particularly glass bottles against breakage, as can be seen, for example, in U.S. Pat. No. 2,706,571 to C. T. Ryan for a bottle muff and in U.S. Pat. No. 2,809,760 to Clark for a bottle protector and teether combination. In a related manner, the art reflects efforts to provide protection against spillage from the bottle to protect the surrounding environs, but which provides no effective protection against direct contact by the nipple with a contaminated surface. Structures of this type are shown in U.S. Pat. Nos. 2,033,296 to Porter and 4,050,600 to Jennings for a container spillage prevention system. Equally ineffective structures are shown in Knutzen U.S. Pat. No. 3,718,360, which provides ringed members for holding the bottle and U.S. Pat. No. 3,990,596, Hoftman, for a handle attachment for the baby bottle itself which can provide some incidental protection for the bottle but which provides no protection for the nipple.

Apparent prior attempts to address the same problem as in the present invention are found in older references including Ladley, U.S. Pat. No. 976,887. This patent describes a nipple cover for use with baby bottles which allegedly provides protection against flies and other insects. The structure described in this reference, however, is designed to retain the cover in a closed position and specifically advocates the use of a structure in which the halves of the cover "rebound" when released to close around the nipple. A similar structure is proposed in U.S. Pat. No. 2,084,689, to Karl, where two sections are provided and which are spring-loaded or otherwise loaded to close the nipple protector upon release of the halves from contact with the child's face. Apart from the rather complicated nature of these structures, it may be observed by the parent of any young child that as soon as these protectors close around the nipple, the child no longer has access to the contents of the bottle. It should be equally apparent that upon closing an immediate and likely irritable and voluminous scream may be expected from especially younger children since many of them simply do not possess the kind of manual dexterity that these structures require to manipulate them during use. In addition, the need for continued "maintenance" and supervision is not alleviated.

Therefore, it is an object of this invention to provide a bottle having a bottle nipple shield which overcomes the shortcomings of the prior art in that continuous effective protection against contamination is provided while at the same time continuous access for the young child to the contents of the bottle is likewise accommodated.

SUMMARY OF THE INVENTION

In order to overcome the problems which characterize the various structures of the prior art as described above, and correspondingly fulfill a need in the art which has simply gone unmet, the baby bottle of this invention includes a bottle nipple shield of unique construction which is extremely convenient for use by parent and child alike. In the structure of the present invention, the bottle nipple shield includes a generally planar base member which mounts a pair of resilient wing members. These wing members project generally upwardly from the base member in spaced apart relation to one another and in substantially parallel relation to the principal axis of the nipple.

The two projecting wing members of the nipple shield terminate in a manner such that their respective upper free ends are positioned in fixed spaced apart relation to one another so that substantially continuous access to the nipple itself is provided for the child. Notably, however, the nipple shield of the present invention nonetheless provides continuous effective protection for the nipple from contamination even when the bottle is dropped on a surface.

In accordance with the primary preferred embodiments of this invention, the nipple shield is adaptable for use with a wide variety of various bottle constructions available in the marketplace and may be adapted within the spirit of this invention in a variety of fashions which may be particularly desirable for children in distinct age groups. In accordance with one particular preferred construction, the wing members are substantially lobular extensions of the base member and which flare radially upwardly and outwardly from the base member. These features provide special, uniquely effective protection when tumbling actions are exerted on the bottle such as those which often accompany the free-fall of the bottle as it leaves the fingertips of toddlers.

The particular preferred lobular end portions additionally protect the nozzle of the nipple from contacting a surface through a full range of motion as would be experienced in lifting the bottle from a surface after it is dropped. A related benefit is that the end of the nipple will not contact interior furnishings as the bottle is lifted by the toddler to protect these items as well. Furthermore, and unlike the prior art structures, the resilient structure of the wing members of the nipple shield provide for excellent extended wear and enhanced overall sanitary conditions since there are no recesses or the like to receive liquid particles which can spoil or otherwise contaminate portions of the nipple shield. In a related manner the shield can optimally be sterilized in any of a number of customary fashions.

BRIEF DESCRIPTION OF THE DRAWINGS

Additional features of the invention will be described hereinbelow in detail when taken in connection with the accompanying drawings and in which.

DESCRIPTION OF THE PREFERRED EMBODIMENTS

Figure 1:
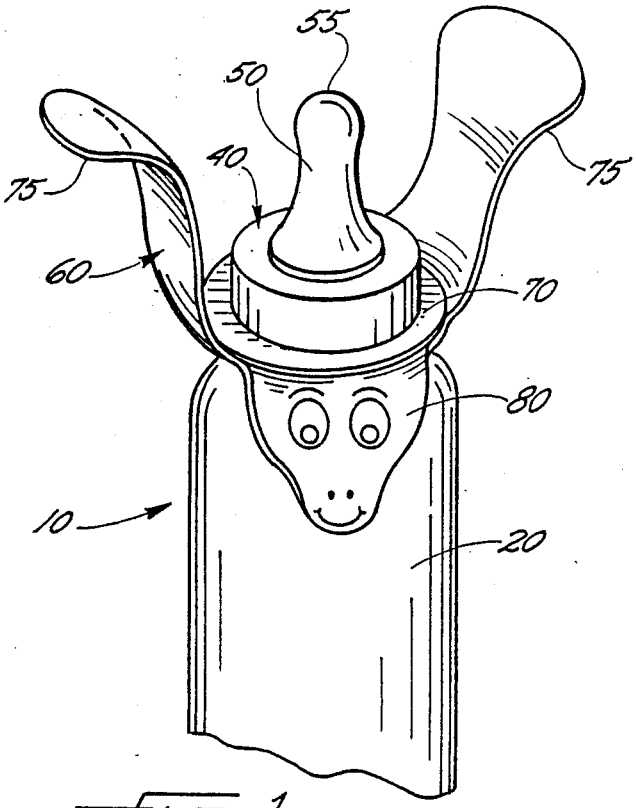
FIG. 1 is a perspective view of the bottle of the present invention incorporating the unique nipple shield.
Figure 5:
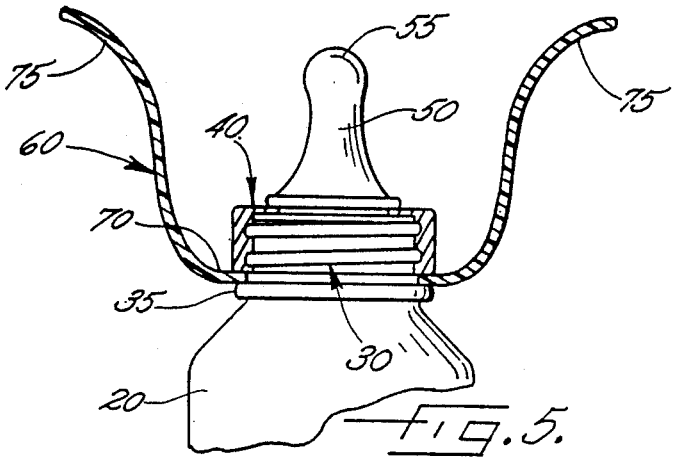
FIG. 5 is a transverse sectional view of the bottle taken through the nipple, nipple shield, and upper neck portion of the bottle taken substantially along the line 5—5 in FIG. 3.

Referring now to FIG. 1 and as can be seen in detail by reference to FIG. 5, the bottle of the present invention 10 includes a generally cylindrical body 20 which has a lower end closed to define a conventional liquid-containing reservoir for the bottle proper and an upper neck portion shown generally at reference character 30 (FIG. 5) which is connected to the body and which is adapted for receiving a bottle closure. In a conventional bottle construction, a bottle closure means generally indicated by 40 cooperates with the threads of the upper neck portion to provide a general closure for the bottle assembly. As is also conventional, the bottle closure means 40 is generally formed with a centrally disposed aperture which additionally receives portions of a flexible nipple member 50. The nipple includes a dispensing nozzle 55 which allows liquids in the liquid-containing reservoir of the bottle to be dispensed through the nozzle 55 in use when pressure is applied to the nipple in a conventional manner.

Figure 6:
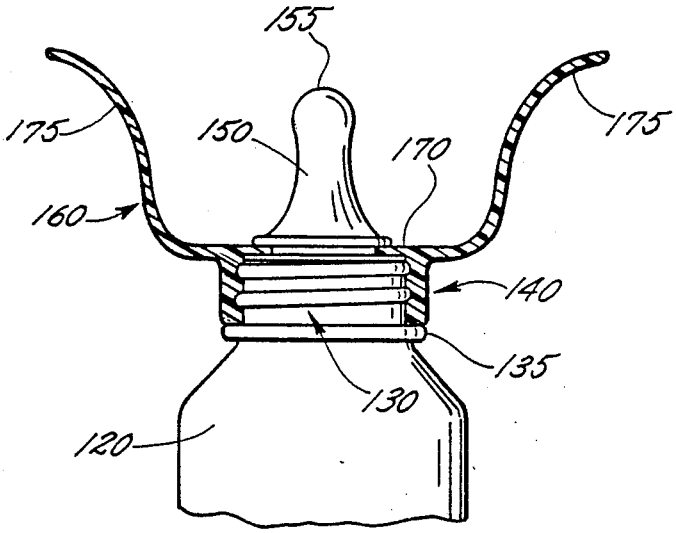
FIG. 6 is a like transverse sectional view showing the elements of the bottle in an alternative embodiment of the invention.

In accordance with the present invention, the preferred bottle nipple shield 60 includes a generally planar base member 70 which mounts a pair of resilient wing members 75. As also is shown in the accompanying drawings, the nipple shield 60 may desirably be constructed as a discrete member having a central aperture which in turn is positioned on a collar 35 (FIG. 5) on upper neck portions 30 of the bottle 10 and then held securely in place by closure 40 which may be of the conventional type in this embodiment. Alternatively, however, the structure may be provided as an entirely unitary assembly as shown, for example, in FIG. 6 wherein the base member of the nipple shield 170, and the closure means 140, as well as the wing members 175 are of an entirely unitary construction.

Figure 7:
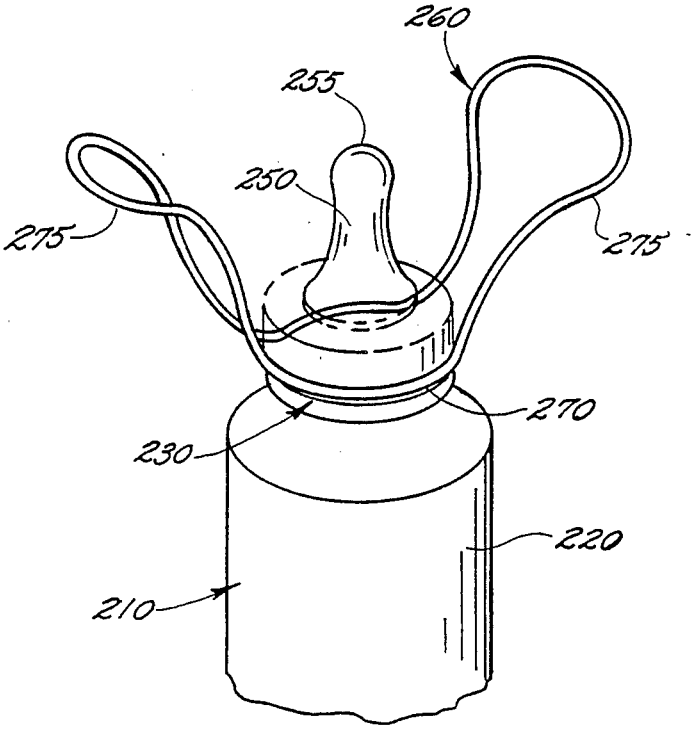
FIG. 7 is a perspective view depicting an additional embodiment of the invention.

The nipple shield 60 of this invention may be constructed from any of a number of otherwise suitable materials including particularly plastic materials approved for general oral uses including, for example, materials used in manufacturing dentures or similar products. In like fashion, the nipple shield 60 may be manufactured by any of a number of known methods available for fashioning such objects including, for example, by injection molding polypropylene, polyethylene, or other plastics or by stamping and forming the wing members 75 from sheet material. Alternatively, and as shown in FIG. 7, the nipple shield 260 may comprise a substantially open structure formed from a wire member. In this alternative embodiment, the base member 270 is defined by opposed parallel lengths of a bent wire member and provides the added advantage that the resilient wire material may simply be slipped over the neck of the bottle and held in spring-loaded, releasable engagement with upper neck portions 230 of the bottle 210. This embodiment may also provide added advantages over the alternative structure shown in FIG. 1, for example, by totally eliminating any surfaces which may retain food particles or the like on the surface of the nipple shield 60.

Figure 2:
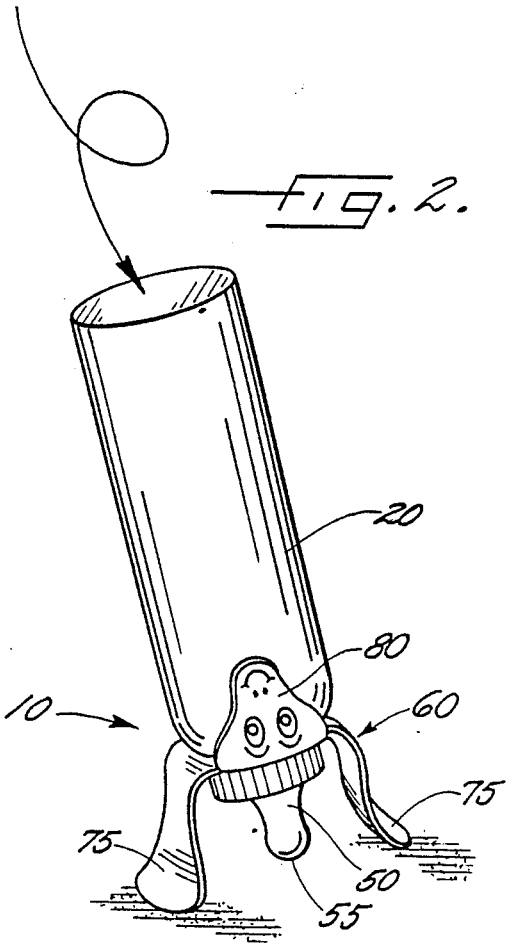
FIG. 2 is an additional perspective view of the bottle of FIG. 1 illustrating the unique effectiveness of the nipple shield when in use.
Figure 3:
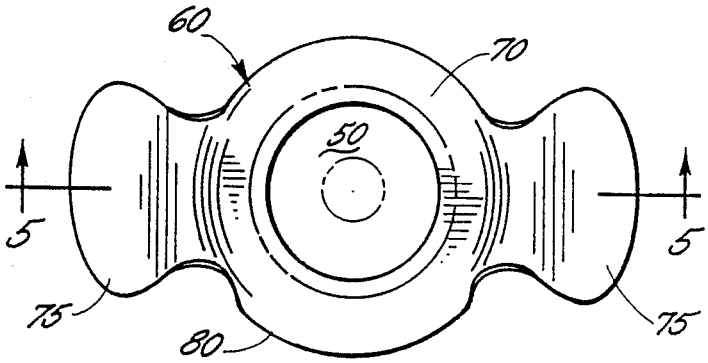
FIG. 3 is a top plan view of the bottle including the nipple shield.

In each of the respective embodiments 60, 160 and 260, these preferred embodiments are characterized by wing members 75, 175, 275, which all terminate at respective upper free ends which are positioned in fixed, spaced apart relation to each other. By this expedient, effective continuous protection is provided for the nipple against contamination. Furthermore, and as shown for example in FIG. 2, the upper free ends of the wing members 75 should be positioned preferably such that they terminate at a plane which is spaced at a greater distance from the base member 70 than is the dispensing nozzle 55 of the nipple, whereby the end of the nipple 55 cannot physically contact the ground or other surface if the bottle is dropped directly on this end (FIG. 2). Furthermore, the wing members 75 are preferably spaced apart at a distance sufficient to allow a child to drink from the bottle without any undue discomfort resulting from incidental contact between the wings and the cheeks of the child. Indeed, it would be especially preferred to size the dimensions of the shield so that no contact will result with the child's face if possible.

In addition to the above, the upper free tips or ends of the projecting wing members 75, 175, 275 may desirably be provided with a protective coating such as a rubberized or urethane type coating which cushions against any inadvertent blows or scrapes to the face when the bottle equipped with the nipple shield is actually in use. With respect to the open shield structure 260 shown in FIG. 7, the resilient wire member may desirably be covered with a plastic coating to likewise provide additional cushioning protection against inadvertent blows. In any event, the material should be such that it will provide sufficient resiliency to be both adequately stiff to avoid undue flexure on contact such as when a bottle is dropped a reasonable distance directly on its end and preferably to prevent the end of the nipple from striking this surface on contact.

In any of the embodiments shown in the drawings, an additional indicia-bearing shield member 80 may be provided (FIG. 1) whose primary appeal resides in providing a surface for personalizing the bottle and nipple shield. In accordance with the preferred embodiment, such indicium may be the face of an animal which may encourage the use of the bottle with the shield. Moreover, the selection of the indicia may be tailored to animals having horns, antlers, or the like to cooperate with the winged members such as, for example, a cow, deer, moose, or reindeer. If sufficiently colorful, such an indicia additionally provides the desirable function of aiding the child in properly orienting the bottle and nipple shield so that the wing members 75 are properly positioned relative to the face to engage the nipple though most children will have no problem with this aspect of utilizing the invention and, for them, the sole function of the indicium is in deriving additional pleasure from the use of the invention.

Figure 4:
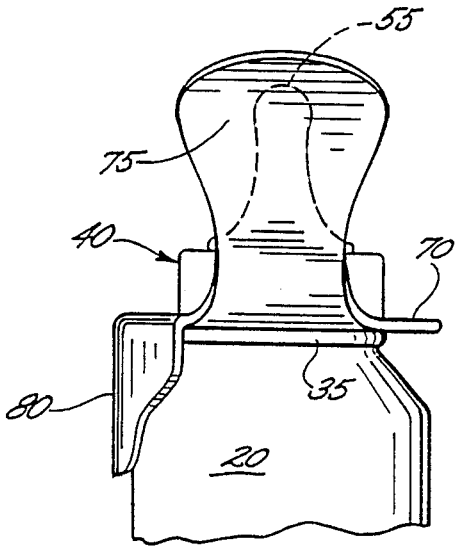
FIG. 4 is a side elevation view of the bottle including the nipple shield.

In accordance with another particularly advantageous aspect of the invention, the wing members 75 mounted on base member 70 of nipple shield 60 are preferably lobular shaped as shown for all of the illustrative embodiments in the accompanying drawings. As best seen in FIG. 4, as well as in FIG. 2, the width of the upper portions of wing members 75 are enlarged in the area adjacent the dispensing nozzle 55 of the nipple 50. The enlarged portion ensures that even as the bottle is rotated in a direction perpendicular to its primary axis, the end of the nipple 55 will not come in contact with a surface on which the bottle is resting. Accordingly, this lobular shape provides additional protection as well for interior furnishings and the like on which the bottle may be inadvertently dropped. More importantly, this ensures that the nipple will not be contaminated as the child attempts to pick the bottle 10 up from a sidewalk or other surface even when the bottle is rotated about its primary axis. In other words, as the bottle is lifted by its bottom, the primary plane of the bottle will be rotated about the upper terminal ends of the wing member 75, rather than on the nipple end. Thus, as alluded to above, the inadvertent discharge of fluid from the nozzle by contacting carpets or other surfaces is avoided while likewise the contamination of the end of the bottle and specifically the tip of the nipple is entirely precluded.

As should be apparent from the foregoing discussion, the present invention overcomes many of the shortcomings associated with known devices for similar uses that do not provide adequate protection for the nipple of a baby bottle or the like and which correspondingly provide continuous access to the nipple. It should be understood that the foregoing drawings and specification are presented for purposes of describing the preferred embodiments only, and that they should not be utilized at all for purposes of unduly limiting the scope of the present invention which scope is defined solely by the appended claims presented hereinbelow.

That which is claimed is:

1. A bottle of the type having a nipple and used for dispensing liquids to young children or the like and which is characterized by the provision, in combination therewith, of a shield for providing greatly enhanced and continuous security for the nipple against damage or contamination if the bottle is inadvertently dropped while providing access to the nipple for dispensing of liquids, said bottle comprising:

a generally cylindrical body having a lower end closed to define a liquid containing reservoir, and an upper neck portion connected to said body and adapted for receiving a closure;

bottle closure means engaging at least portions of said neck portion and including a centrally disposed aperture formed therethrough;

a flexible nipple having a principal axis disposed in coaxial relation to said cylindrical body and having lower portions extending through the aperture formed in said bottle closure means and upper portions defining a dispensing nozzle for the bottle; and a bottle nipple shield comprising:

a generally planar base member defining a central bore in substantially coaxial relation to said flexible nipple and mounting a pair of resilient wing members, said wing members of the nipple shield projecting generally upwardly from said base member in opposed spaced apart relation to one another and in substantially parallel relation to the principal axis of the nipple, said projecting wing members additionally terminating with their respective upper free ends positioned in fixed, spaced apart relation to one another and in spaced apart framing relationship to said nipple whereby effective continuous protection against significant nipple contamination is provided when the bottle is in use.

2. A bottle according to claim 1 wherein said bottle closure means and said bottle nipple shield are of unitary construction with portions of said bottle closure means defining the base member of the bottle nipple shield and with the wing members projecting from said bottle closure means.

3. A bottle according to claim 1 wherein said base member of the bottle nipple shield is adapted for spring-loaded releasable engagement with said upper neck portions of the bottle.

4. A bottle according to claim 1 wherein said bottle nipple shield additionally comprises an indicium bearing shield member extending in a generally planar direction substantially parallel to the axis of the nipple.

5. A bottle according to claim 1 wherein said projecting wing members comprise lobular extensions of said base member which additionally flare radially outwardly from said base member to provide ease of access to the nipple.

6. A bottle according to claim 1 wherein the respective upper free ends of the projecting wing members terminate in a common plane which is spaced away from said base member at a greater distance than is the dispensing nozzle to provide maximum protection for the nipple.

7. A bottle according to claim 3 wherein said base member of the bottle nipple shield comprises a substantially open structure.

8. A bottle according to claim 3 wherein said upper neck portion comprises a threaded band and a collar, the bore defined by said base member is positioned in coaxial abutting relation to said collar and wherein said closure comprises a screw cap securely holding the base member in engagement against the collar.

9. A bottle according to claim 7 wherein said bottle nipple shield is formed of resilient wire material defining a substantially open structure.

* * * * *